US008511774B2

(12) United States Patent
Shimosato

(10) Patent No.: US 8,511,774 B2
(45) Date of Patent: Aug. 20, 2013

(54) DRIVING APPARATUS AND DRIVING METHOD FOR INKJET HEAD

(75) Inventor: Masashi Shimosato, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 255 days.

(21) Appl. No.: 13/025,089

(22) Filed: Feb. 10, 2011

(65) Prior Publication Data

US 2012/0069070 A1 Mar. 22, 2012

(30) Foreign Application Priority Data

Sep. 21, 2010 (JP) ..... 2010-211292

(51) Int. Cl.
*B41J 29/38* (2006.01)

(52) U.S. Cl.
USPC ..... 347/10

(58) Field of Classification Search
CPC ..... B41J 2/04551; B41J 2/04573
USPC ..... 347/9–11, 68, 70–72
See application file for complete search history.

(56) References Cited

U.S. PATENT DOCUMENTS 5,781,203 A * 7/1998 Uriu et al. ..... 347/9

FOREIGN PATENT DOCUMENTS

| | | |
|---|---|---|
| JP | 03-221459 A | 9/1991 |
| JP | 04-207462 | 7/1992 |
| JP | 06-031919 | 2/1994 |
| JP | 10-016213 | 1/1998 |
| JP | 2006-082259 | 3/2006 |
| JP | 2009-220288 | 10/2009 |

OTHER PUBLICATIONS

Japanese Application No. 2010-211292 Office Action (Dec. 25, 2012) (English translation submitted).

* cited by examiner

*Primary Examiner* — An Do
(74) *Attorney, Agent, or Firm* — Patterson & Sheridan, L.L.P.

(57) ABSTRACT

According to one embodiment, a driving apparatus configured to drive an inkjet head configured to cause plural nozzles to discharge ink according to deformation of an electromechanical energy converting element includes: a signal generating unit configured to generate a driving signal to be applied to the electromechanical energy converting element; and a setting unit configured to set, with respect to a reference waveform, a delay time of a waveform of the driving signal in the nozzles by using a random number generated by a random number generator.

20 Claims, 11 Drawing Sheets

DRIVING APPARATUS AND DRIVING METHOD FOR INKJET HEAD

CROSS-REFERENCE TO RELATED APPLICATION(S)

This application is based upon and claims the benefit of priority from Japanese Patent Application No, 2010-211292, filed on Sep. 21, 2010; the entire contents of which are incorporated herein by reference.

FIELD

Embodiments described herein relate to a driving apparatus and a driving method for an inkjet head for discharging ink to form an image.

BACKGROUND

An inkjet head includes plural ink chambers in which ink is filled, plural nozzles formed in the ink chambers, and plural driving elements provided in the ink chambers and configured to cause the nozzles to discharge the ink. As the driving elements, piezoelectric elements configured to change the capacity of the ink chambers to discharge the ink or heat generating elements configured to generate air bubbles in the ink chambers to discharge the ink is used.

When a driving pulse signal is applied to the driving elements, the driving elements operate and ink droplets are discharged from the nozzles corresponding to the driving elements.

Dimensions of the plural ink chambers and dimensions of the diameters of the nozzles included in one inkjet head are not always uniform. There is also fluctuation in performance of the heat generating elements. Even if a driving pulse signal of the same voltage is applied to the plural driving elements, the volume of the ink discharged from the nozzles is not always the same. In some cases, density unevenness occurs in an image formed by the discharge of the ink.

DETAILED DESCRIPTION

According to one embodiment, a driving apparatus configured to drive an inkjet head configured to cause plural nozzles to discharge ink according to deformation of an electromechanical energy converting element includes: a signal generating unit configured to generate a driving signal to be applied to the electromechanical energy converting element; and a setting unit configured to set, with respect to a reference waveform, a delay time of a waveform of the driving signal in the nozzles by using a random number generated by a random number generator.

An embodiment is explained below with reference to the accompanying drawings.

Figure 1:
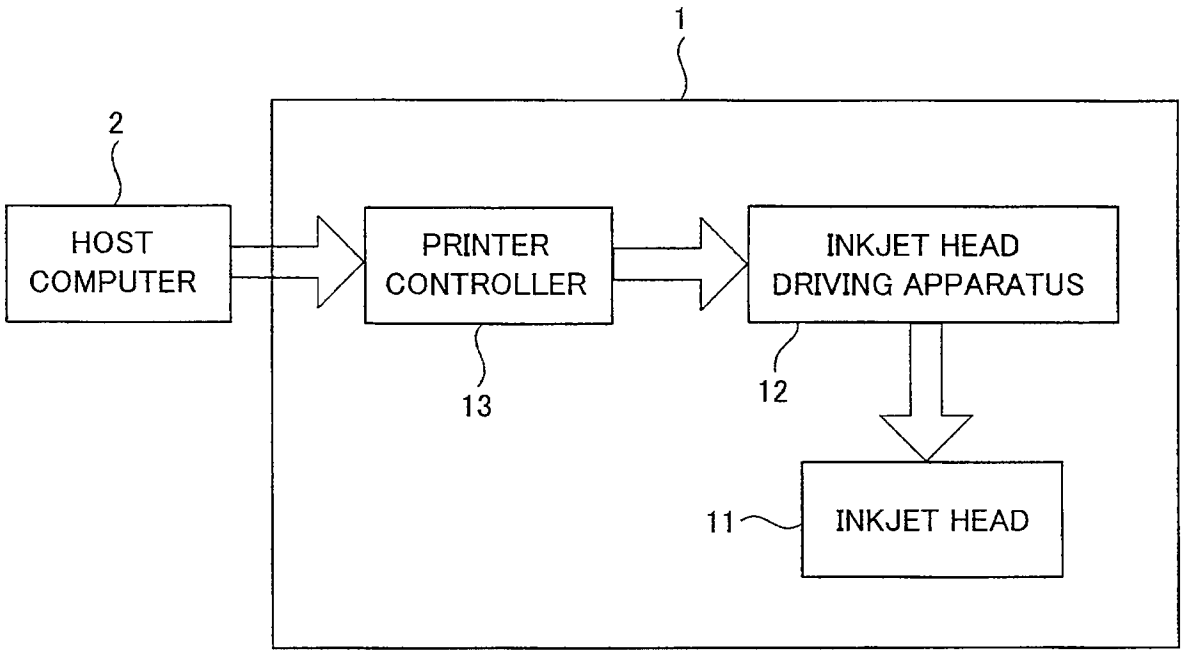
FIG. 1 is a block diagram of a schematic configuration of an inkjet printer.

FIG. 1 is a block diagram of a schematic configuration of an inkjet printer 1. The inkjet printer 1 includes an inkjet head 11, a driving apparatus 12 configured to drive the inkjet head 11, and a printer controller 13 configured to control units of the inkjet printer 1 including the driving apparatus 12. The printer controller 13 is connected to a host computer 2 configured to output printing data. When the printer controller 13 receives the printing data from the host computer 2, the printer controller 13 controls the operations of the units (including the inkjet head 11 and the driving apparatus 12) of the inkjet printer 1 and performs printing of a sheet.

Figure 2:
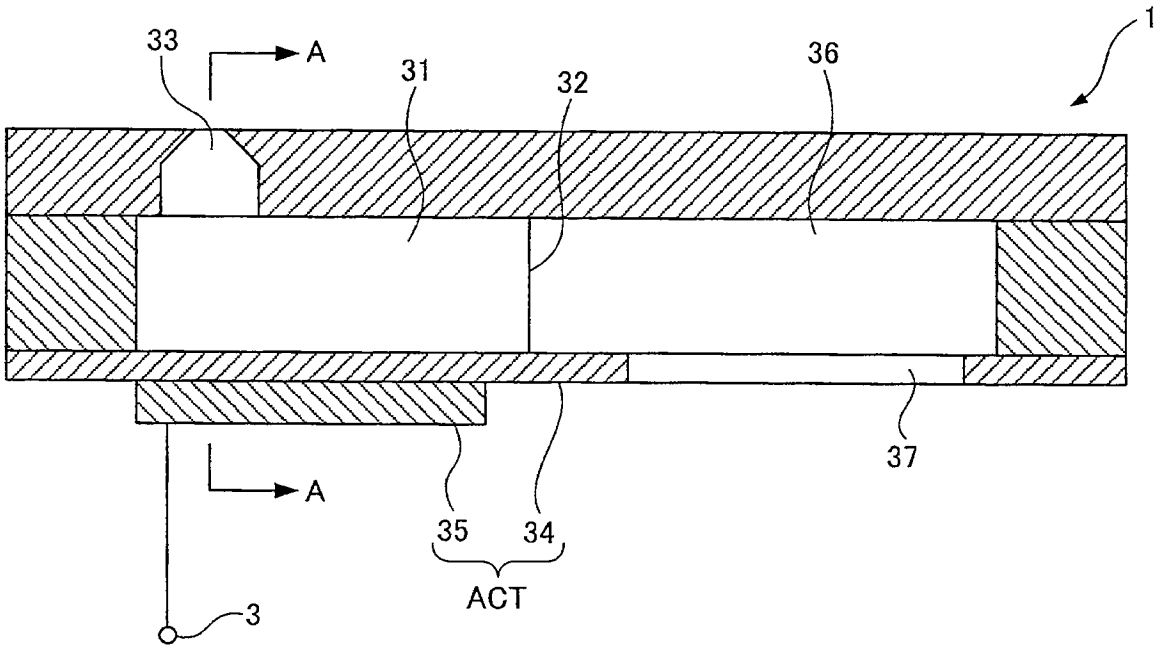
FIG. 2 is a sectional view of a main part configuration of an inkjet head.
Figure 3:
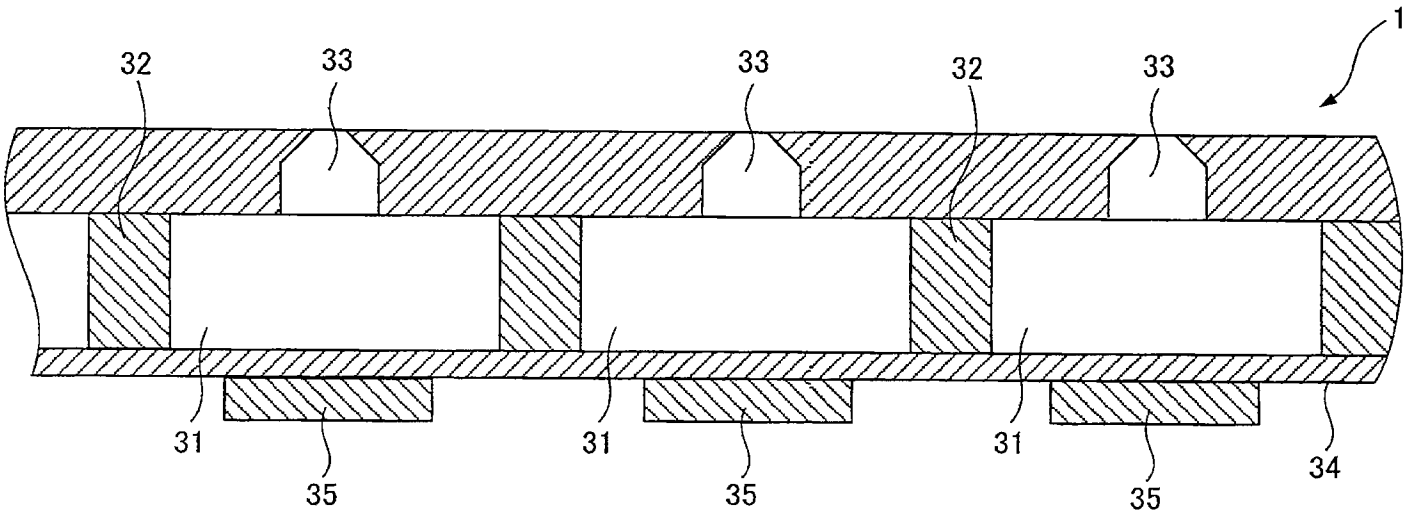
FIG. 3 is a sectional view taken along line A-A in FIG. 2.

A main part configuration of the inkjet head 11 is explained with reference to FIGS. 2 and 3. FIG. 3 is a sectional view taken along line A-A in FIG. 2.

The inkjet head 11 includes plural ink chambers 31 for storing ink. The ink chambers 31 are partitioned by partition walls 32. The ink chambers 31 include nozzles 33 for discharging the ink. The plural nozzles 33 are arranged in one direction. In the inkjet printer 1, a sheet and the inkjet head 11 relatively move in a direction orthogonal to an array direction of the plural nozzles 33.

Bottom surfaces of the ink chambers 31 are formed of an oscillating plate 34. In the oscillating plate 34, piezoelectric members 35 corresponding to the ink chambers 31 are fixed to a surface on the opposite side of a surface that forms the ink chambers 31. The oscillating plate 34 and the piezoelectric members 35 configure actuators ACT serving as driving elements. The piezoelectric members 35 are electrically connected to an output terminal 3 of the driving apparatus 12.

The inkjet head 11 includes a common ink chamber 36 that communicates with the ink chambers 31. The ink is injected into the common ink chamber 36 from an ink supplying unit (not shown) through an ink supply port 37. The ink is filled in the common ink chamber 36, the ink chambers 31, and the nozzles 33.

A structure for discharging the ink is not limited to the structure explained in this embodiment. The structure only has to be a structure for discharging the ink using piezoelectric members. Specifically, the partition walls that partition the ink chambers 31 are formed of the piezoelectric members. The ink can be discharged by deforming the piezoelectric members to change the capacity of the ink chambers.

Driving waveforms in driving the piezoelectric members 32 are explained with reference to FIG. 4. The driving waveforms shown in FIG. 4 are generated by the driving apparatus 12 and input to the inkjet head 11.

Figure 4:
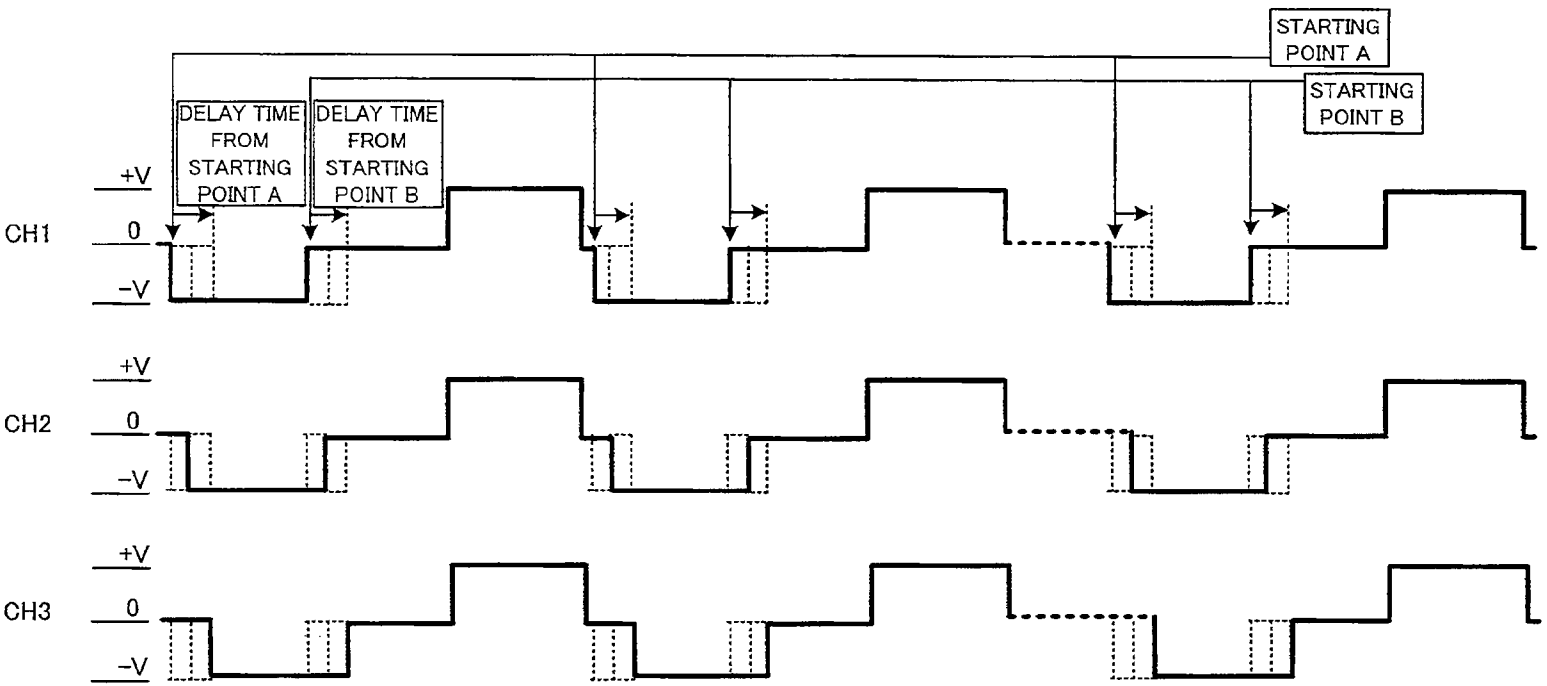
FIG. 4 is a diagram of driving waveforms applied to piezoelectric members.

In FIG. 4, a driving waveform CH1 indicates a reference driving waveform. At a starting point A of the driving waveform CH1, an output voltage changes from 0 [V] to −V [V] and the internal pressure of the ink chambers 31 decreases. If the internal pressure of the ink chambers 31 decreases, the ink flows from the common ink chamber 36 to the ink chambers 31. The ink chambers 31 are filled with the ink. At a starting point B when a predetermined time elapses from the starting point A, the output voltage changes from −V [V] to 0 [V] and the internal pressure of the ink chambers 31 increases. When the internal pressure of the ink chambers 31 increases, the ink filled in the ink chambers 31 is discharged from the nozzles 33.

When a predetermined time elapses from the starting point B, the output voltage changes from 0 [V] to +V [V]. It is possible to intermittently discharge the ink from the nozzles 33 of the inkjet head 11 by applying the driving waveform CH1 shown in FIG. 4 to the piezoelectric members 34.

Driving waveforms CH2 and CH3 are waveforms obtained by delaying the starting points A and B with respect to the driving waveform CH1. A delay time in the driving waveform CH3 is longer than a delay time in the driving waveform CH2.

Figure 5:
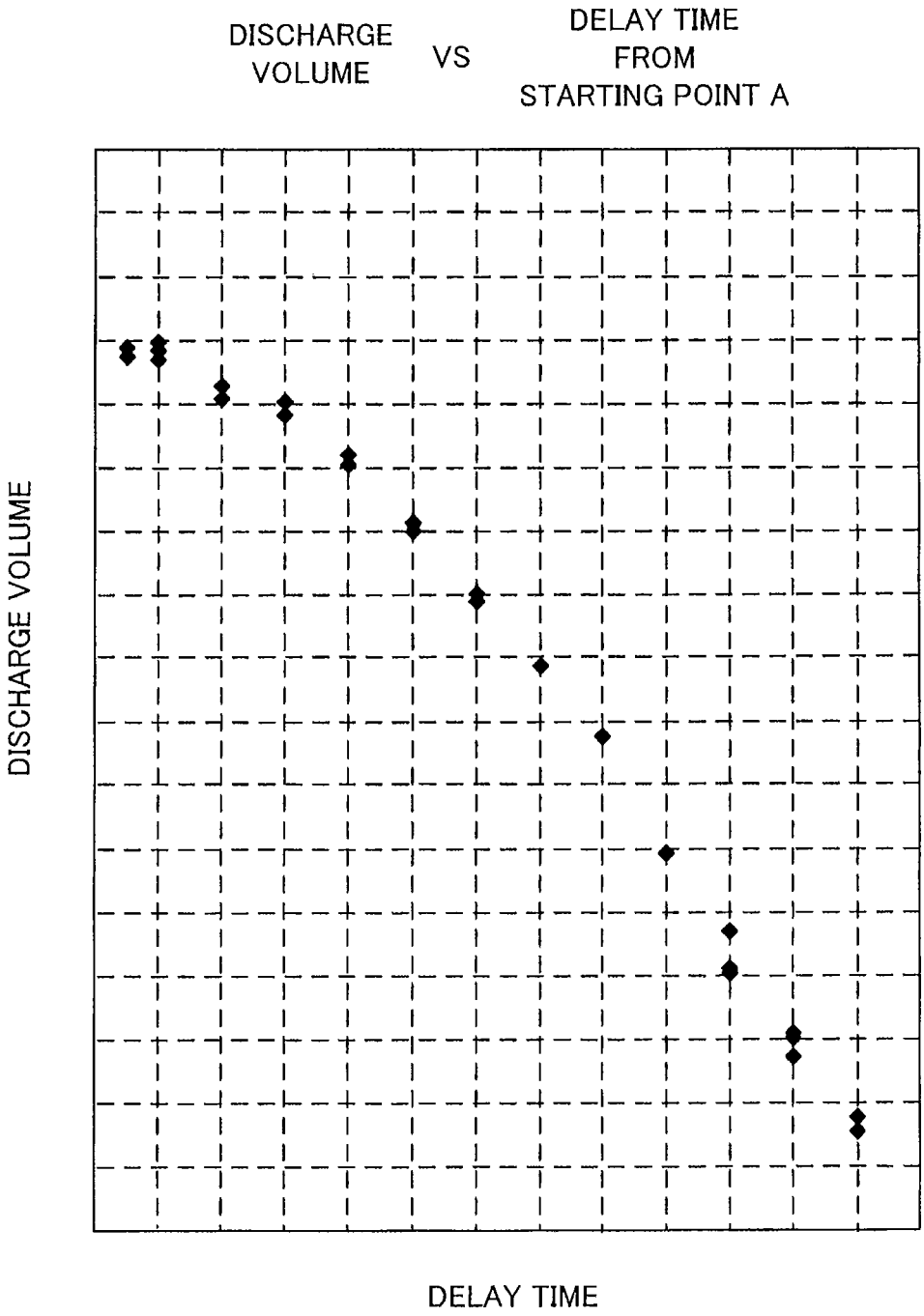
FIG. 5 is a graph of a relation between a delay time from a starting point A and a discharge volume of ink.

A relation between a delay time and a discharge volume of the ink in the case in which only the starting point A is delayed with respect to the reference driving waveform CH1 is shown in FIG. 5. As shown in FIG. 5, as the delay time from the starting point A is longer, the discharge volume of the ink further decreases. A period between the starting point A and the starting point B is a period in which the ink is drawn into the ink chambers 31. Therefore, as the starting point A is further delayed, the ink is less easily drawn into the ink chambers 31. As the delay time from the starting point A is longer, the discharge volume of the ink further decreases.

Figure 6:
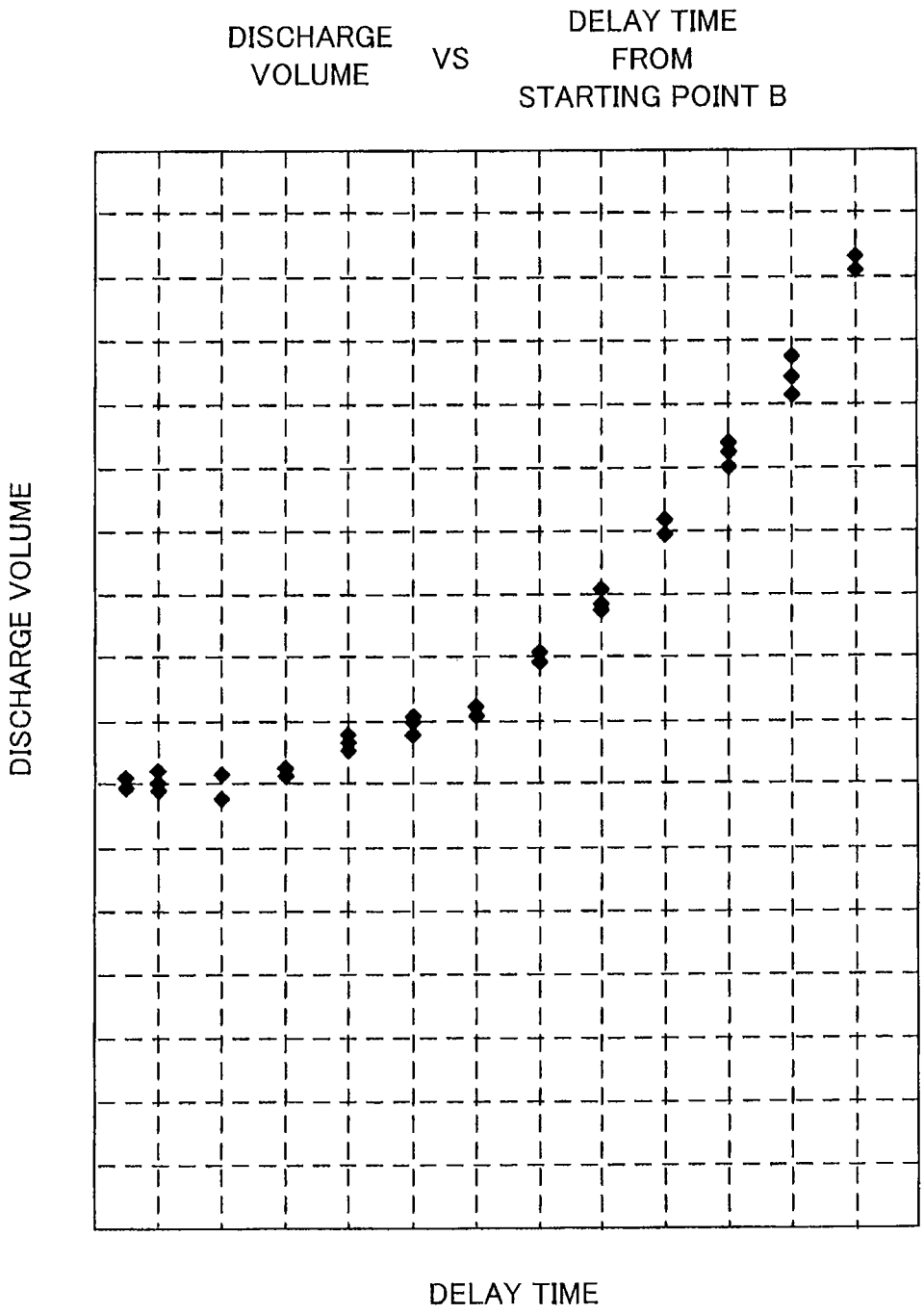
FIG. 6 is a graph of a relation between a delay time from a starting point B and a discharge volume of the ink.

A relation between a delay time and a discharge volume of the ink in the case in which only the starting point B is delayed with respect to the reference driving waveform CH1 is shown in FIG. 6. As shown in FIG. 6, as the delay time from the starting point B is longer, the discharge volume of the ink further increases. As the starting point B is further delayed, time in which the ink is drawn into the ink chambers 31 is longer and a larger amount of the ink is drawn into the ink chambers 31. If the ink is discharged in a state in which a larger amount of the ink is drawn into the ink chambers 31, it is possible to increase the discharge volume of the ink.

Figure 7:
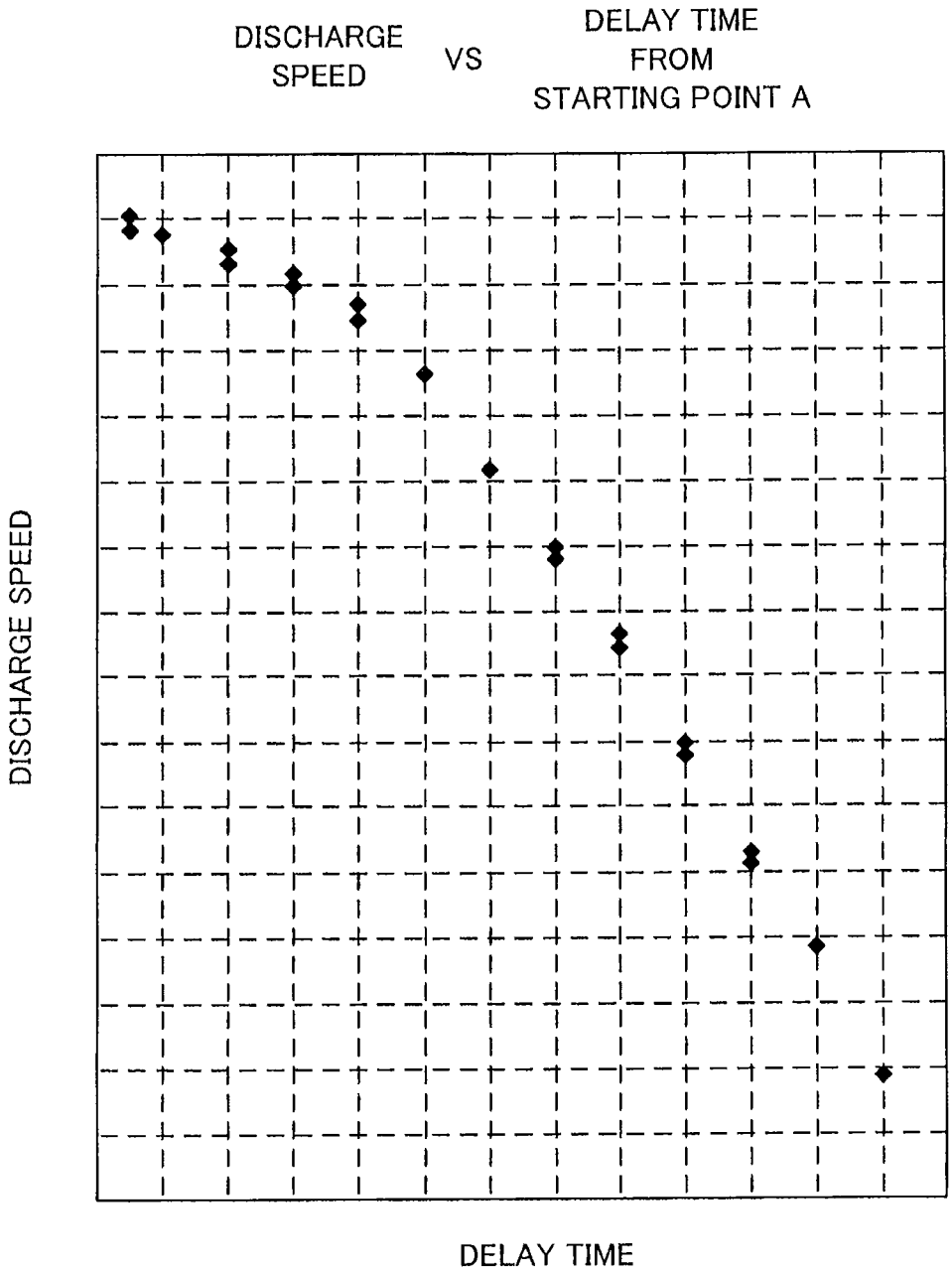
FIG. 7 is a graph of a relation between a delay time from the starting point A and discharge speed of the ink.
Figure 8:
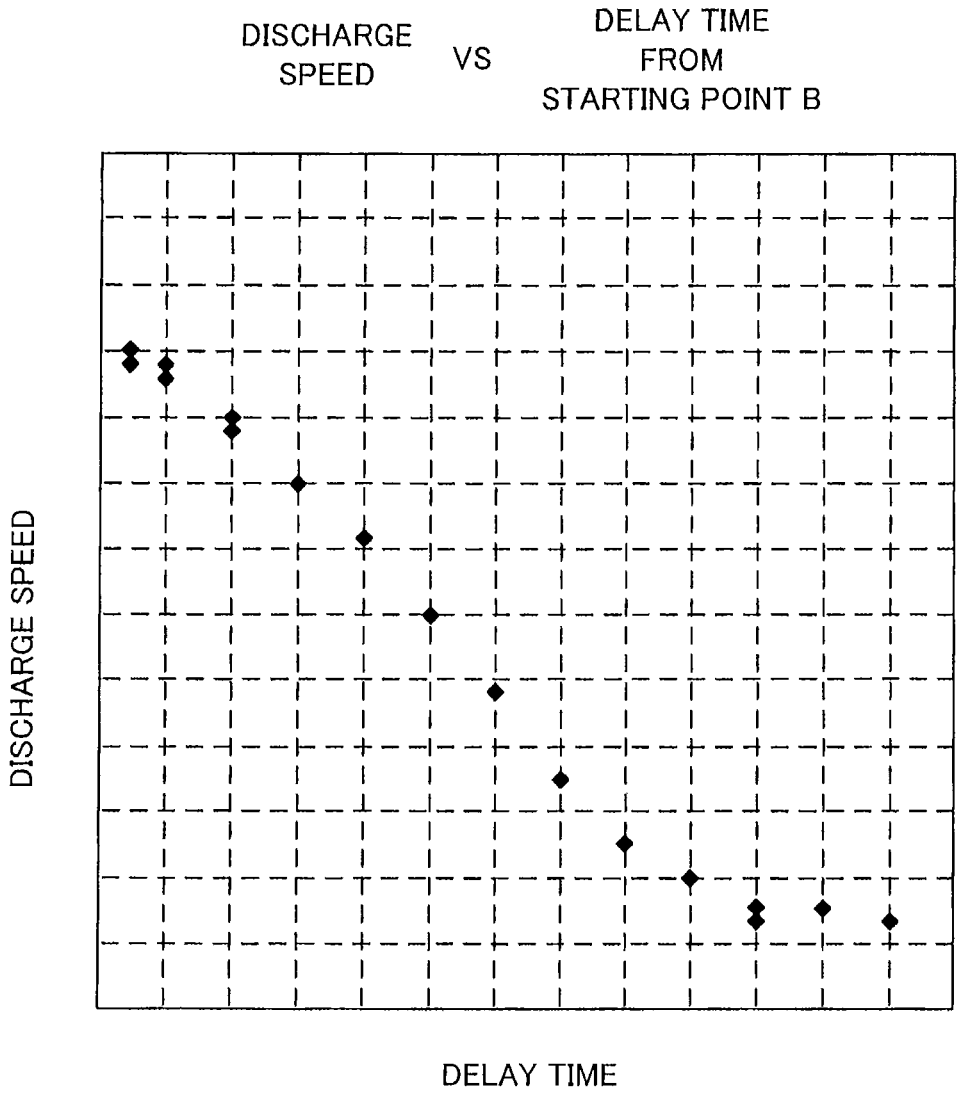
FIG. 8 is a graph of a relation between a delay time from the starting point B and discharge speed of the ink.

In FIG. 7, a relation between a delay time and discharge speed of the ink in the case in which only the starting point A is delayed with respect to the reference driving waveform CH1 is shown. As shown in FIG. 7, as the delay time from the starting point A is longer, the discharge speed of the ink further decreases. In FIG. 8, a relation between a delay time and discharge speed of the ink in the case in which only the starting point B is delayed with respect to the reference driving waveform CH1 is shown. As shown in FIG. 8, as the delay time from the starting point B is longer, the discharge speed of the ink further decreases.

Figure 9:
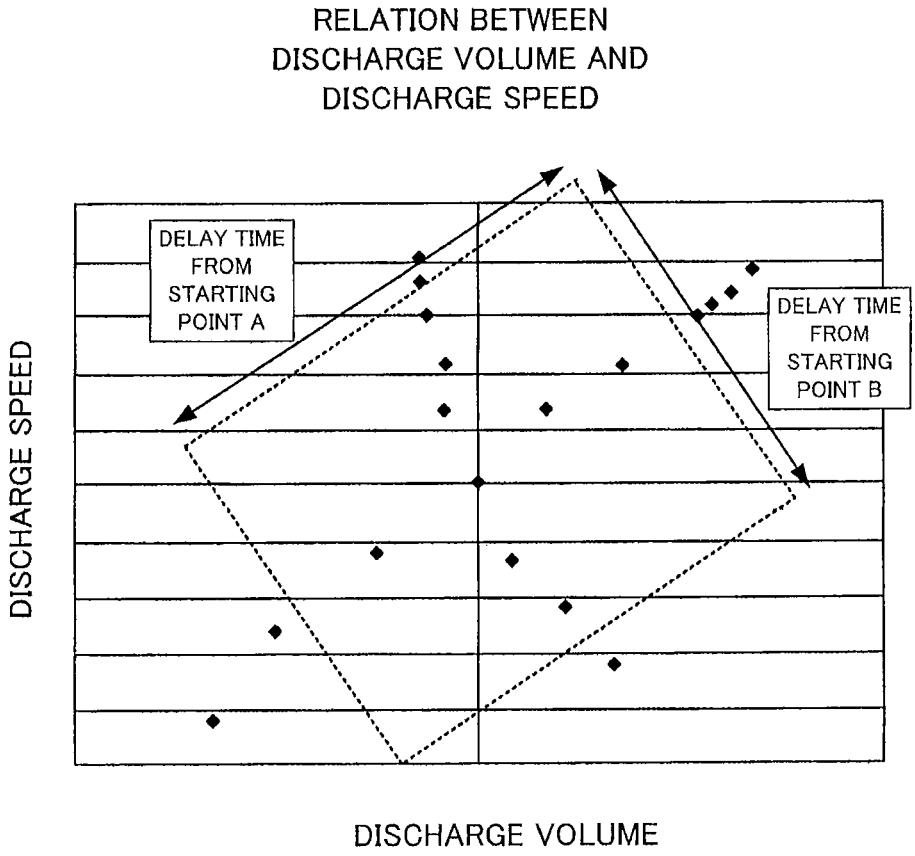
FIG. 9 is a graph of a relation between a discharge volume and discharge speed of the ink.

FIG. 9 is a diagram of a relation between discharge speed of the ink and a discharge volume of the ink. As explained with reference to FIGS. 5 to 8, at the starting point A, as the delay time is longer, the discharge volume further decreases and the discharge speed further decreases. At the starting point B, as the delay time is longer, the discharge volume further increases and the discharge speed further decreases. At the starting point A and the starting point B, the relations between the delay time and the discharge volume are opposite. Therefore, it is possible to change the discharge volume while keeping the discharge speed constant. It is possible to change the discharge speed while keeping the discharge volume constant.

If a main cause of density unevenness of an image formed on a sheet is a discharge direction of the ink, it is possible to cause fluctuation in the discharge speed of the ink while keeping the discharge volume of the ink constant. When the discharge speed of the ink changes, a potion where the ink reaches the sheet changes. It is possible to make the density unevenness less conspicuous by causing fluctuation in the discharge speed of the ink and causing fluctuation in the position where the ink reaches the sheet.

If the main cause of the density unevenness of the image formed on the sheet is not the discharge direction of the ink, it is possible to cause fluctuation in the discharge volume of the ink while keeping the discharge speed of the ink constant. It is possible to make the density unevenness less conspicuous by causing fluctuation in an amount of the ink while keeping the position where the ink reaches the sheet.

It is possible to select which of the discharge volume and the discharge speed of the ink is given priority. It is possible to prepare a mode for giving priority to the discharge volume and a mode for giving priority to the discharge speed and allow a user to select any one of the two modes.

Figure 10:
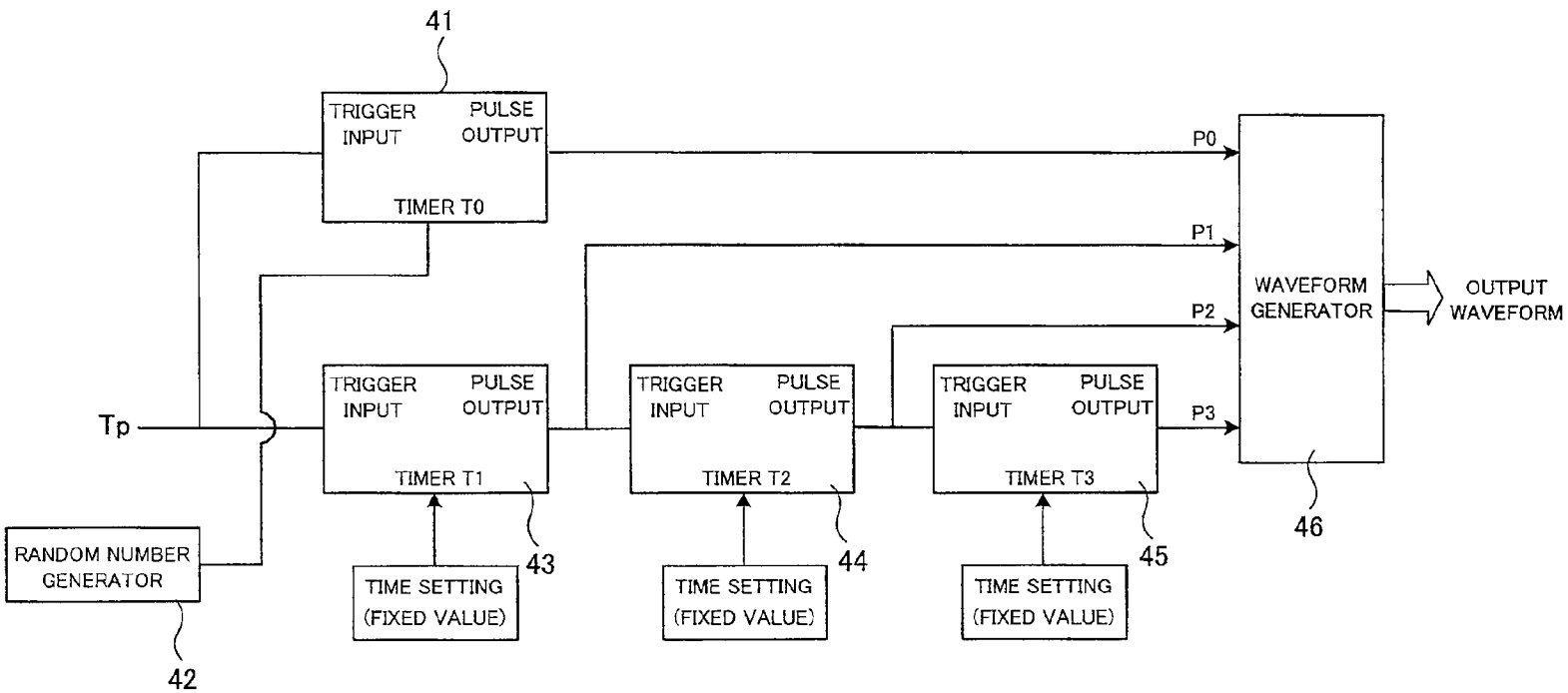
FIG. 10 is a diagram of a circuit configured to generate a driving waveform for the piezoelectric members.

A circuit configuration for generating a driving waveform to be applied to the piezoelectric members 34 is explained with reference to FIG. 10. A circuit shown in FIG. 10 is included in the driving apparatus 12.

Figure 11:
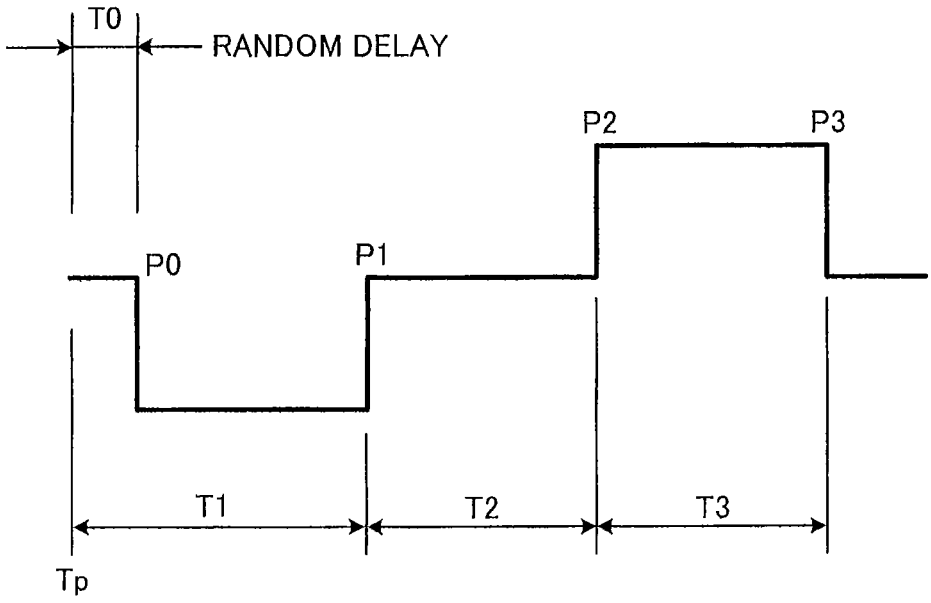
FIG. 11 is a diagram for explaining a driving waveform for the piezoelectric members.

A first timing determining unit 41 determines timing P0 shown in FIG. 11. Trigger at timing Tp is input to the first timing determining unit 41. A random number generated by the random number generator 42 is input to a terminal of the timer T0. A second timing determining unit 43 determines timing P1 shown in FIG. 11. The trigger at the timing Tp is input to the second timing determining unit 43. Time T1 as a fixed value is input to a terminal of a timer T1.

A third timing determining unit 44 determines timing P2 shown in FIG. 11. The trigger at the timing Tp is input to the third timing determining unit 44. Time T2 as a fixed value is input to a terminal of a timer T2. A fourth timing determining unit 45 determines timing P3 shown in FIG. 11. The trigger at the timing Tp is input to the fourth timing determining unit 45. Time T3 as a fixed value is input to a terminal of a timer T3.

A waveform generator 46 generates, on the basis of the timings P0 to P3 determined by the first to fourth timing determining units 41, 43, 44, and 45, a driving waveform to be applied to the inkjet head 11.

In this embodiment, it is possible to make density unevenness of an image formed on the sheet less conspicuous by discharging the ink from the nozzles 33 at random.

In this embodiment, a driving waveform is generated at random for each of the nozzles 33. However, the present invention is not limited to this. Specifically, every time one pixel is formed using one nozzle 33, it is possible to cause fluctuation in a discharge volume and discharge speed of the ink. When one pixel is formed by plural ink droplets, it is possible to cause fluctuation in the discharge volume and the discharge speed of the ink while the plural ink droplets are discharged. A driving waveform for causing fluctuation is the same as that explained with reference to FIG. 11.

In the plural nozzles 33, it is possible to prepare a mode for causing fluctuation in the discharge volume and the discharge speed of the ink, a mode for causing fluctuation in the discharge volume and the discharge speed of the ink when one pixel is formed, and a mode for causing fluctuation in the discharge volume and the discharge speed of the ink when one pixel is formed by plural ink droplets. The user can select any one of the three modes as appropriate.

While certain embodiments have been described, these embodiments have been presented by way of example only, and are not intended to limit the scope of invention. Indeed, the novel embodiments described herein may be embodied in a variety of other forms; furthermore, various omissions, substitutions and changes in the form of the embodiments described herein may be made without departing from the sprit of the inventions. The accompanying claims and their equivalents are intended to cover such forms or modifications as would fall within the scope and spirit of the inventions.

What is claimed is:

1. A driving apparatus for an inkjet head, comprising:

a signal generating unit configured to generate a driving signal to be applied to an electromechanical energy converting element configured to cause plural nozzles of the inkjet head to discharge ink according to deformation of the electromechanical energy converting element;

a random number generator configured to generate a random number; and a setting unit configured to set a delay time, with respect to a reference waveform, for a waveform of the driving signal corresponding to a respective nozzle of the plurality of nozzles by using the random number generated by the random number generator.

2. The apparatus according to claim 1, wherein the setting unit sets a delay time for each of a plurality of waveforms of the driving signal, each of the plurality of waveforms corresponding to a respective nozzle of the plurality of nozzles.

3. The apparatus according to claim 1, wherein the plurality of nozzles is configured to discharge plural ink droplets to form one pixel, and the setting unit sets a delay time for each of a plurality of waveforms of the driving signal for each one pixel.

4. The apparatus according to claim 1, wherein the setting unit is configured to set the delay time with respect to timing for reducing internal pressure of ink chambers configured to store the ink.

5. The apparatus according to claim 1, wherein the setting unit is configured to set the delay time with respect to timing for increasing internal pressure of ink chambers configured to store the ink.

6. The apparatus according to claim 1, wherein the setting unit is configured to set the delay time with respect to timing for reducing internal pressure of ink chambers configured to store the ink and timing for increasing the internal pressure of the ink chambers.

7. The apparatus according to claim 1, wherein the electromechanical energy converting element is a piezoelectric element.

8. A method for driving an inkjet head, comprising:

generating a driving signal to be applied to an electromechanical energy converting element configured to cause plural nozzles of the inkjet head to discharge ink according to deformation of the electromechanical energy converting element; and setting a delay time, with respect to a reference waveform, for a waveform of the driving signal corresponding to the nozzles by using a random number generated by a random number generator.

9. The method according to claim 8, wherein a delay time is set for each of a plurality of waveforms of the driving signal, each of the plurality of waveforms corresponding to a respective nozzle of the plurality of nozzles.

10. The method according to claim 8, wherein the plurality of nozzles is configured to discharge plural ink droplets to form one pixel, and the delay time is set for each of a plurality of waveforms of the driving signal for each one pixel.

11. The method according to claim 8, wherein the delay time is set with respect to timing for reducing internal pressure of ink chambers configured to store the ink.

12. The method according to claim 8, wherein the delay time is set with respect to timing for increasing internal pressure of ink chambers configured to store the ink.

13. The method according to claim 8, wherein the delay time is set with respect to timing for reducing internal pressure of ink chambers configured to store the ink and timing for increasing the internal pressure of the ink chambers.

14. An inkjet printer comprising:

an inkjet head including plural nozzles and an electromechanical energy converting element configured to cause the nozzles to discharge ink according to deformation of the electromechanical energy converting element; and a driving apparatus including a signal generating unit configured to generate the driving signal to be applied to the electromechanical energy converting element, and a setting unit configured to set a delay time, with respect to a reference waveform, for a waveform of the driving signal corresponding to a respective nozzle of the plural nozzles by using a random number generated by a random number generator.

15. The printer according to claim 14, wherein the setting unit sets a delay time for a plurality of waveforms of the driving signal, each of the plurality of waveforms corresponding to a respective nozzle of the plurality of nozzles.

16. The printer according to claim 14, wherein the plurality of nozzles is configured to discharge plural ink droplets to form one pixel, and the setting unit sets a delay time for a plurality of waveforms of the driving signal for each one pixel.

17. The printer according to claim 14, wherein the inkjet head includes plural ink chambers corresponding to the plural nozzles and configured to store the ink, and an oscillating plate forming the ink chambers, wherein the oscillating plate is configured to oscillate according to the deformation of the electromechanical energy converting element and discharge the ink.

18. The printer according to claim 14, wherein the inkjet head includes plural ink chambers corresponding to the plural nozzles and configured to store the ink, wherein the electromechanical energy converting element is configured to deform in a first direction for reducing internal pressure of the ink chambers and to deform in a second direction for increasing the internal pressure of the ink chambers.

19. The printer according to claim 14, wherein the setting unit is configured to set the delay time with respect to, in the reference waveform, at least one timing of timing for reducing internal pressure of ink chambers configured to store the ink and timing for increasing the internal pressure of the ink chambers.

20. The printer according to claim 14, wherein the electromechanical energy converting element is a piezoelectric element.

* * * * *